United States Patent [19]

Nelson

[11] 4,061,399

[45] Dec. 6, 1977

[54] MINING BY INSERTION OF CUTTING MODULES INTO SHAFT FOR CONNECTION AND ACTUATION

[75] Inventor: Rodney L. Nelson, Falls Creek, Pa.

[73] Assignee: Ray M. Baughman, DuBois, Pa. ; a part interest

[21] Appl. No.: 664,191

[22] Filed: Mar. 5, 1976

[51] Int. Cl.[2] ..... E21C 41/00

[52] U.S. Cl. ..... 299/18

[58] Field of Search ..... 299/11, 18, 19, 30; 175/52, 90

[56] References Cited

U.S. PATENT DOCUMENTS

| | | | |
|---|---|---|---|
| 1,406,351 | 2/1922 | Corrigan | 175/90 |
| 3,881,775 | 5/1975 | McPherson | 175/90 X |
| 3,892,442 | 7/1975 | Janssen | 299/11 |
| 3,975,053 | 8/1976 | Kochanowsky | 299/18 X |

*Primary Examiner*—Ernest R. Purser

*Attorney, Agent, or Firm*—Brady, O'Boyle & Gates

[57] ABSTRACT

A shaft is formed from ground level downwardly to a subterranean seam of coal or other solids following preliminary survey procedures to locate the seam and establish its dimensions. A passage is cut radially into the coal seam and away from the shaft near the bottom thereof while coal cuttings are removed and delivered to ground level. The seam is then cut on an arcuate path centered on said shaft along the entire length of the radial passage while coal cuttings continue to be removed and delivered through the shaft to ground level. The mining apparatus is modular and comprises plural mining modules to be placed in the coal seam by a placement and advancing unit which is lowered in the shaft. A rotational driving unit is subsequently lowered in the shaft to drive coupled mining modules in unison through the coal seam on said arcuate path. In addition, self-propelled modules can drive themselves radially from the shaft outwardly into the seam and under remote control from ground level can propel themselves on a second path, e.g. an arcuate or, if desirable, a straight path, along one side of the radial cut.

12 Claims, 22 Drawing Figures

FIG.1
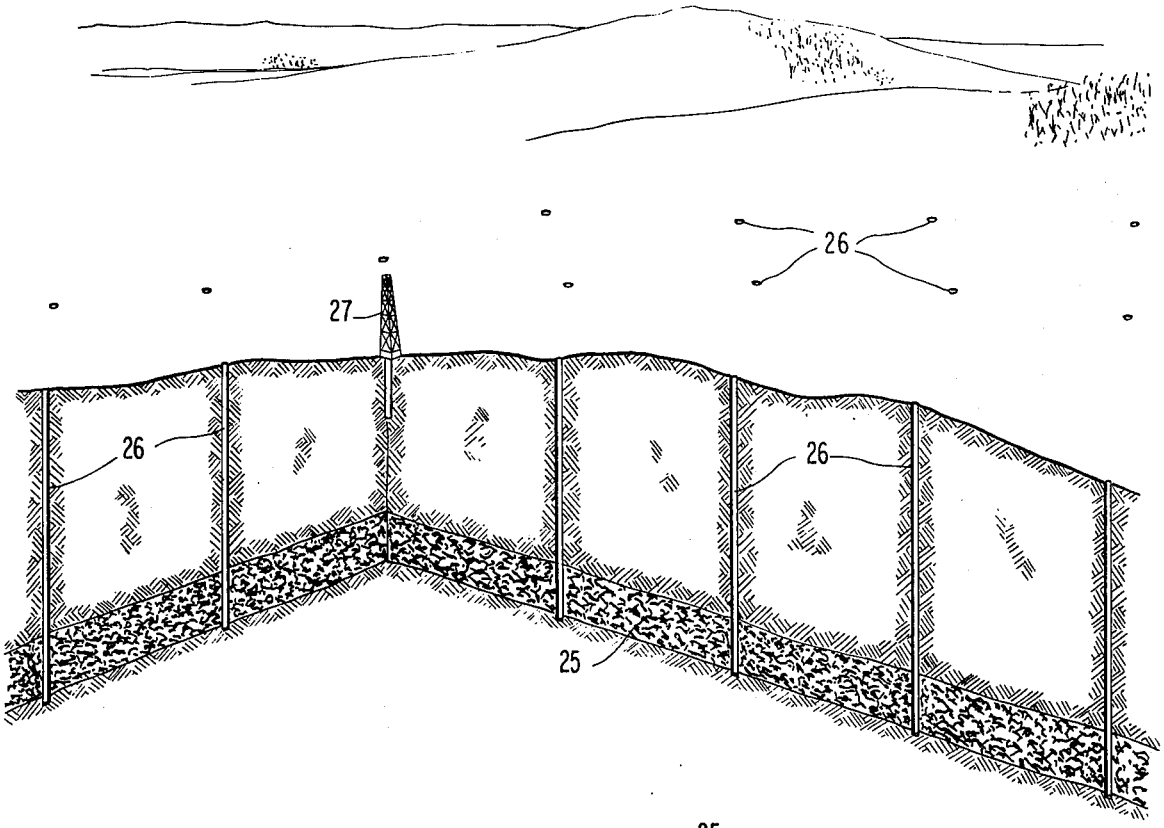
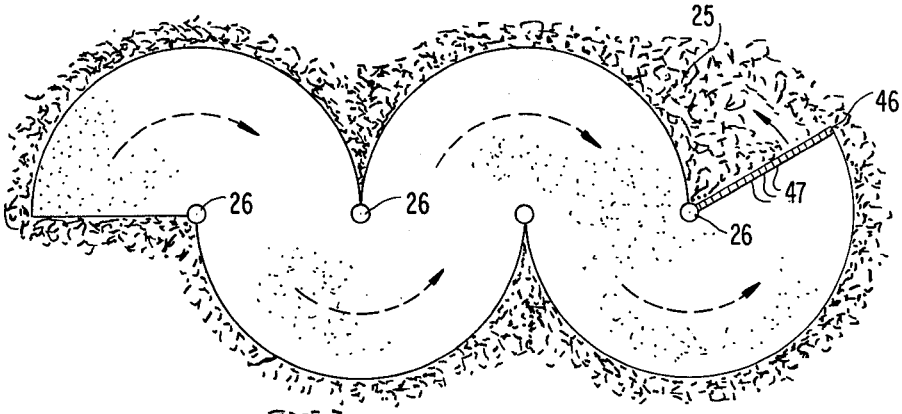
FIG.2a
FIG.2c
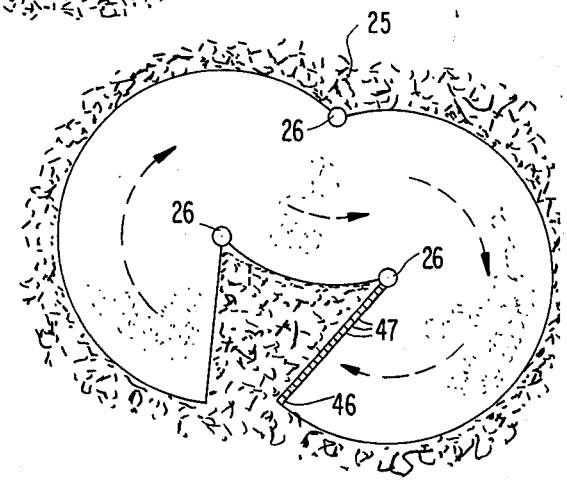
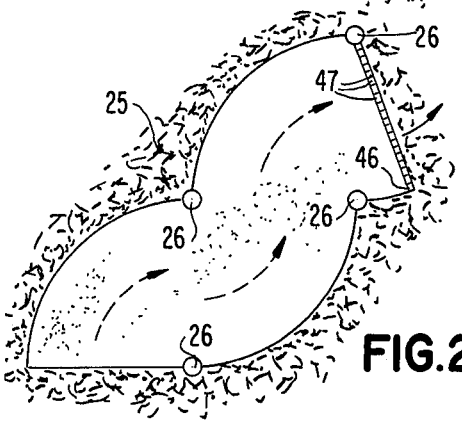
FIG.2b

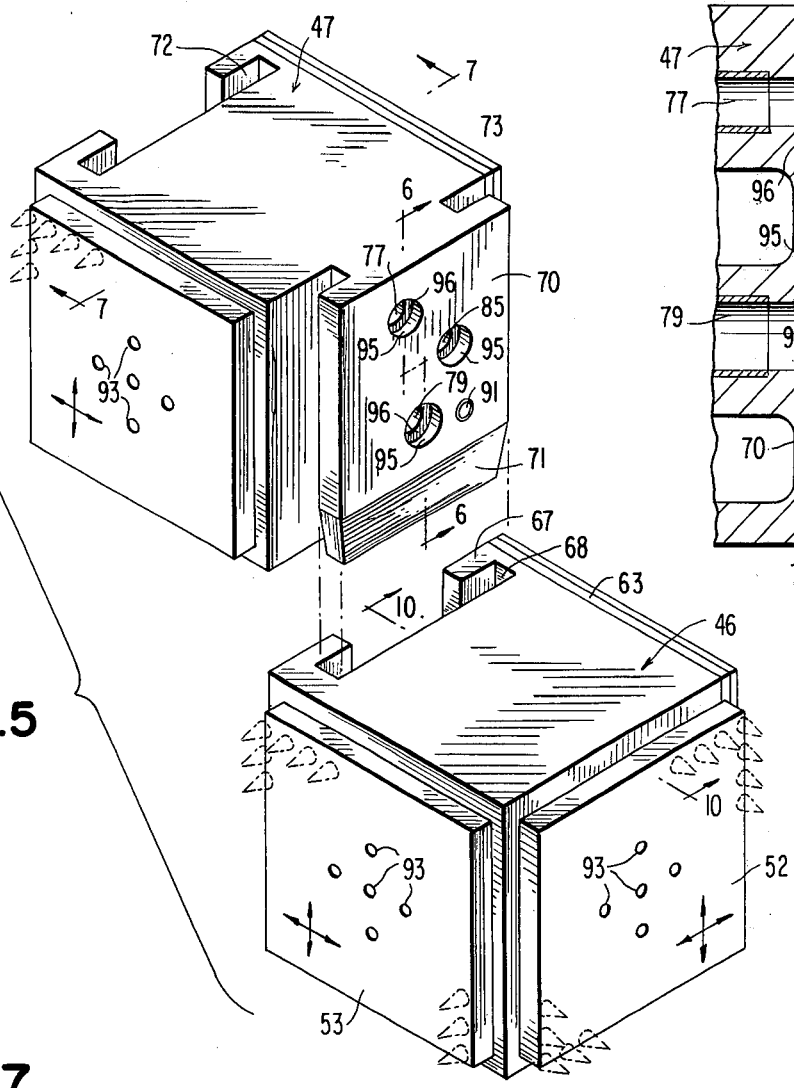
FIG.5
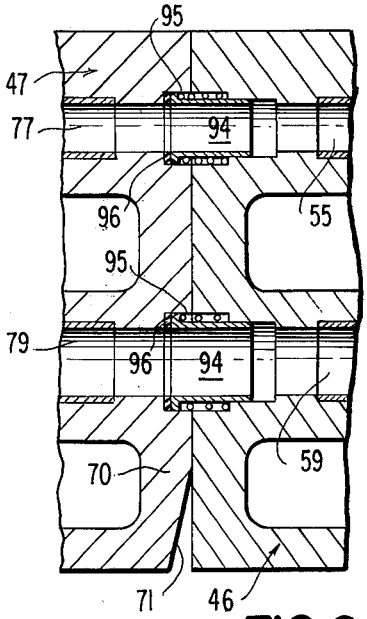
FIG.6
FIG.7
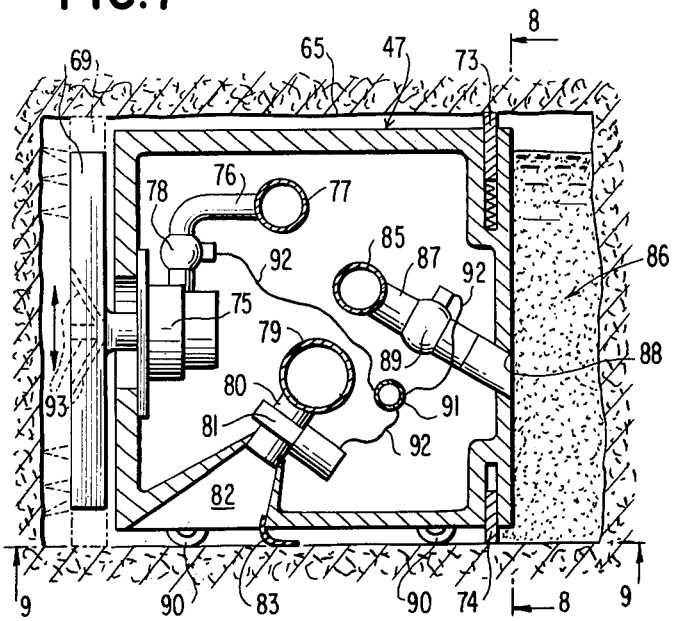
FIG.8
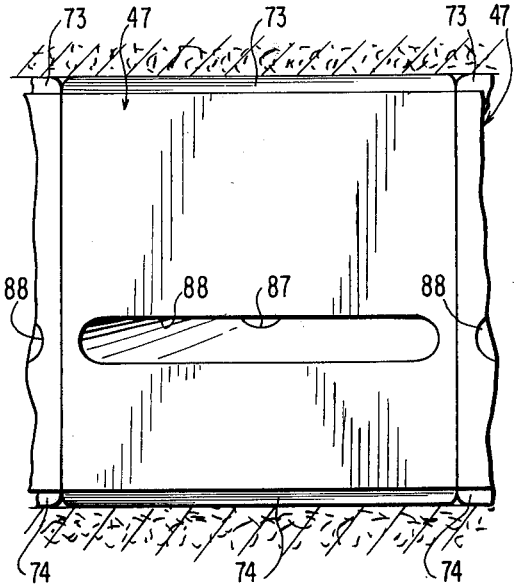

FIG. 17
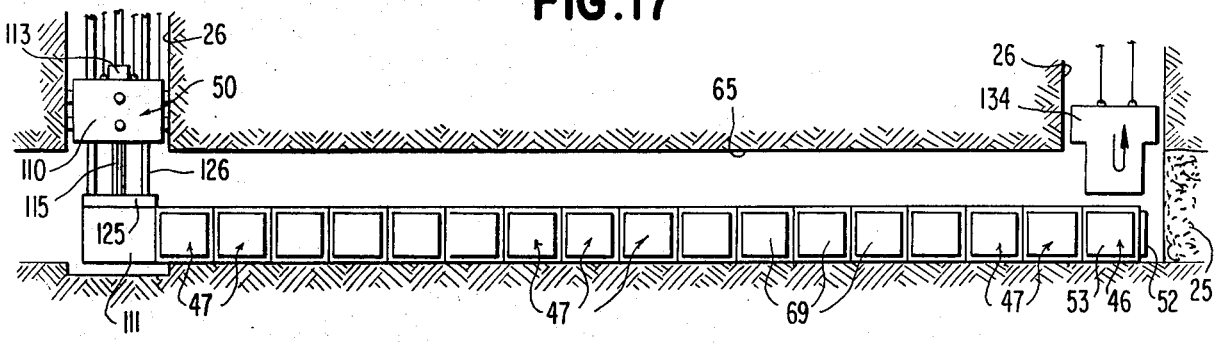
FIG. 18
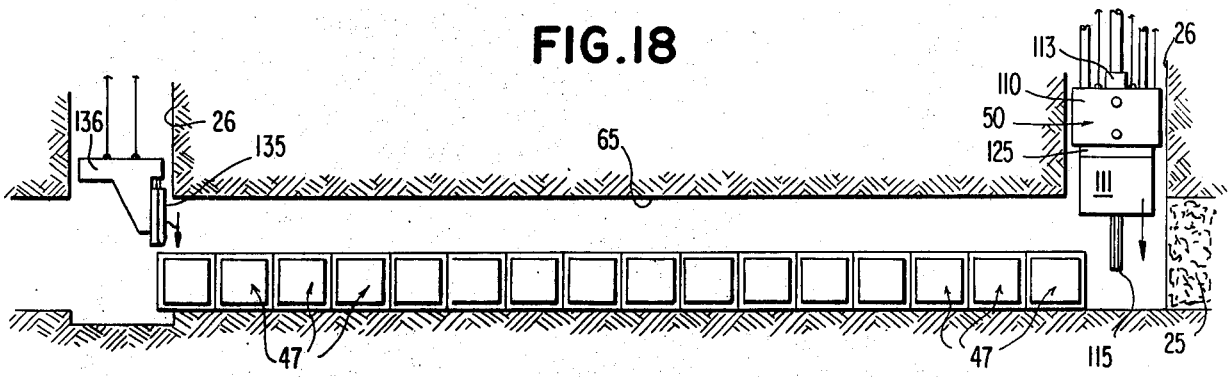
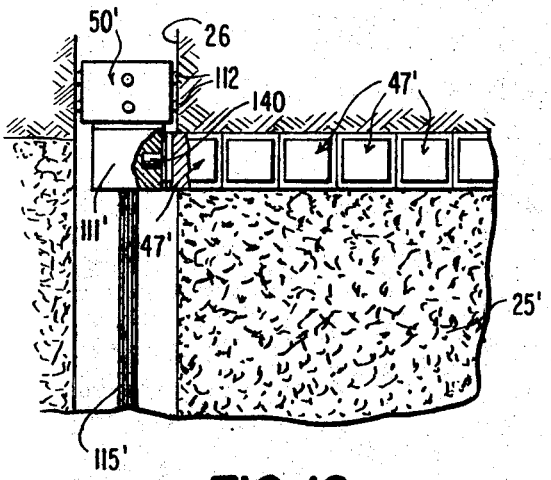
FIG. 19
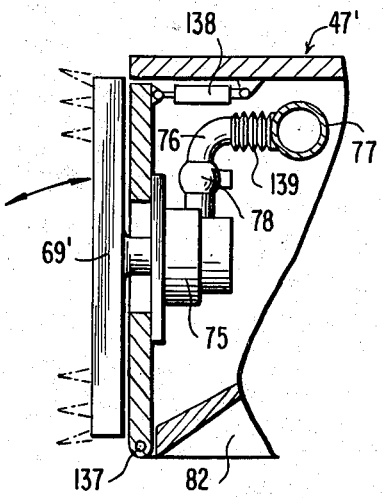
FIG. 20

MINING BY INSERTION OF CUTTING MODULES INTO SHAFT FOR CONNECTION AND ACTUATION

BACKGROUND OF THE INVENTION

The world engery crisis has renewed the emphasis on mining coal as a primary source of energy, both domestically and abroad. In order to obtain coal economically from deep sources where most coal reserves are now located, there is an urgent need to modernize and improve on traditional mining methods and machinery which are costly, inefficient and notoriously hazardous to human life. Also, it is known that traditional mining procedures recover only about 50%-55% of existing coal from deep mines, which is intolerably wasteful in the present day economy.

Ideally, a mining method for deeply embedded coal or other solid minerals invovles the recovery of substantially all coal from a given subterranean location without the necessity for human workers to descend below ground level during the mining operations. It is therefore the primary object of this invention to provide a coal mining method and apparatus for practicing the method which will closely approximate the ideal in terms of the above economics and safety requirements.

SUMMARY OF THE INVENTION

In accordance with the present invention, subterranean seams of coal or other solids of almost any thickness are located and measured with accuracy and a network of shafts on known centers are formed from ground level into the coal seam. Mining modules are placed individually at the bottom of one shaft by a module placement and advancing unit and the modules in rigidly coupled relationship are forced into the coal seam on a radial path extending outwardly from the shaft. The leading module has forward and side cutting heads, and all trailing modules have side cutting heads only. When all mining modules of the string are embedded in the coal seam, a rotational driving unit is lowered in the shaft and coupled with the rearmost module and is operated to drive the coupled string of modules through the coal seam in one direction on an arcuate path of movement centered on the shaft. During penetration of the coal seam radially and on the arcuate path, coal cutting are continuously removed from the seam and delivered above ground in water slurry form, water for this purpose being supplied downwardly through the shaft and through passages of the modules to also drive the cutting head motors and cool the cutting heads of the individual mining modules.

When the leading mining module reaches a second shaft at the coal seam, such module is extracted from the second shaft and the rotational driving unit is lowered in the second shaft and coupled to the next adjacent module in the rigid string for driving the modules on a second arcuate path through the coal seam centered on the second shaft. This procedure is repeated at subsequent shafts in order to mine practically all of the coal in the seam. The apparatus may also be operated in a complete circle mode centered on one shaft to bore out the coal from a deep seam over a wide circular area surrounding the shaft.

Other features and advantages of the invention will become apparent during the course of the following description.

BRIEF DESCRIPTION OF DRAWING FIGURES

FIG. 1 is a partly schematic fragmentary cross section through irregular terrain having a deep coal seam and showing plural shafts on measured centers extending from ground level into the coal seam.

FIGS. *2a, 2b* and *2c* are diagrammatic plan views showing variations in the method of mining coal from the seam by driving a rigid string of modular mining elements on arcuate paths through the seam while centered on various shafts.

FIG. 5 is an exploded perspective view showing a leading module and an adjacent side cutting module and associated coupling means.

FIG. 6 is an enlarged fragmentary vertical section taken on line 6—6 of FIG. 5 showing spring-urged interface fluid passage seals.

FIG. 7 is a transverse vertical cross section through a side cutting module taken on line 7—7 of FIG. 5.

FIG. 8 is a rear side elevational view of the side cutting module taken on line 8—8 of FIG. 7.

FIG. 17 is a diagrammatic cross sectional view showing a coupled string of mining modules at the bottom of a coal seam after having been rotated as a unit around the center of one shaft by the rotational driving unit in such shaft, the leading module having reached a second shaft where it is about to be extracted through the second shaft by a module lifting unit.

FIG. 18 is a similar view showing the rotational unit being lowered in the second shaft for coupling with the adjacent side cutting module at such shaft, the remote side cutting module at the first shaft receiving an end sealing device being lowered in the first shaft by an elevating and lowering unit.

FIG. 19 is a fragmentary vertical section through a deep coal seam and intersecting shaft and showing a coupled string of mining modules having a horizontal axis swiveled connection with a rotational driving unit whereby the string of modules can turn somewhat on its axis responsive to angular adjustment of side cutting heads during full circle boring of the deep coal seam.

FIG. 20 is a fragmentary vertical cross section showing a pivoted side cutting head on a mining module and power operated head angle adusting means.

Figure 4:
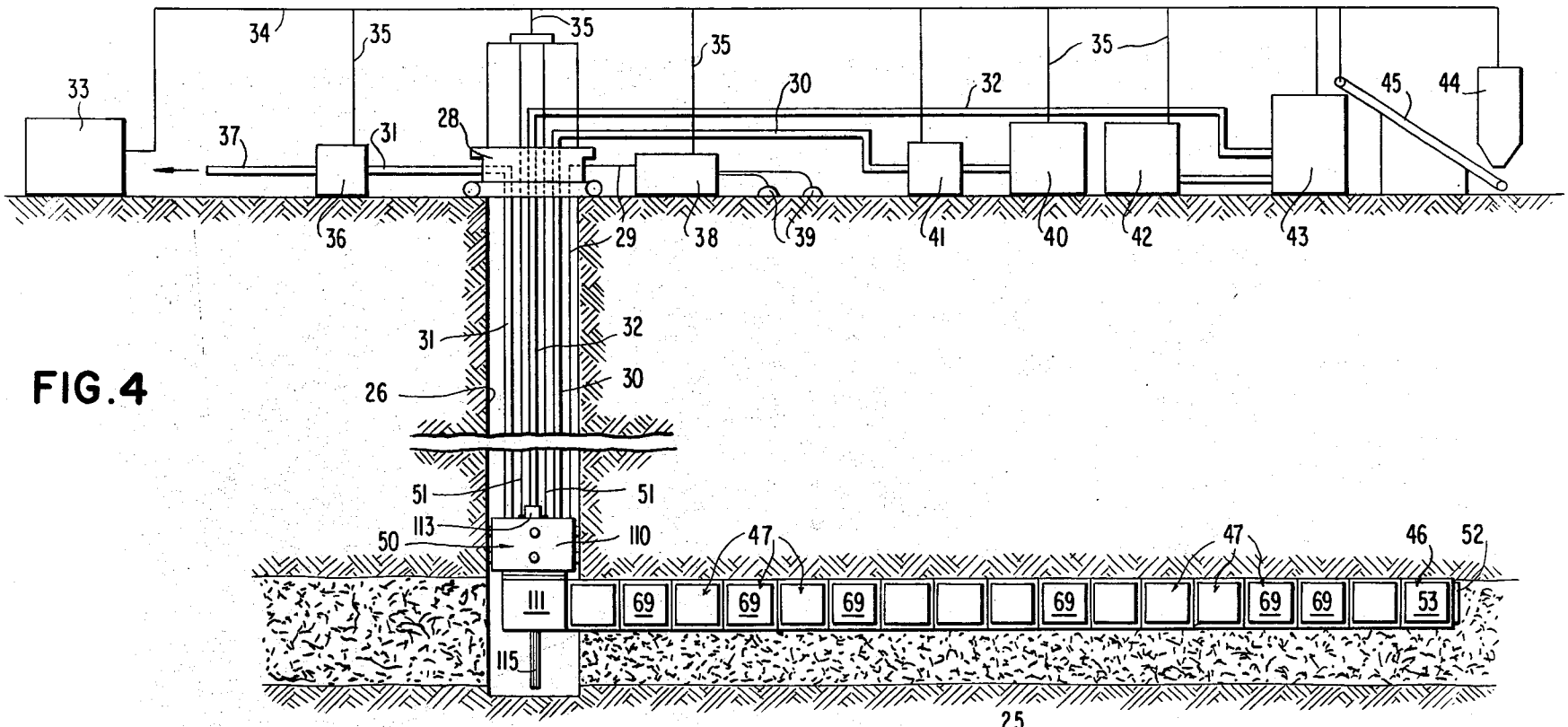
FIG. 4 is a view similar to FIG. 3 showing a rotational driving unit for coupled mining modules near the bottom of the shaft to drive the modules on an arcuate path through the seam centered on the shaft.

As employed herein, the term "coal" is meant to include all minable solids and the terms "coal mining" and "mining of coal" are intended to include the mining of any and all solids.

DETAILED DESCRIPTION OF PREFERRED EMBODIMENT

Referring to the drawings in detail wherein like numerals designate like parts, and referring initially to FIG. 1 wherein the numeral 25 designates a well-defined coal seam at a considerable depth below ground level in an irregular terrain region. One feature of the present invention is that the method employed renders it economical and feasible to mine coal from relatively narrow seams of the order of 18 inches to two feet in thickness. The invention is also applicable to coal mining situations where very thick seams are involved, as will be further explained in the application.

Following an aerial survey, core sampling and seismographic survey procedures, a plurality of comparatively narrow shafts 26 on measured centers are formed from ground level downwardly through the coal seam 25, as illustrated. The formation of one shaft 26 by conventional drilling equipment 27 is indicated in FIG. 1. The number and spacing of the shafts 26 as well as their diameter will vary depending upon such factors as the established area of the coal seam, its thickness and its depth below ground level. Such factors will dictate the size of mining machinery modules to be placed in the coal seam and this in turn will dictate the size of the shafts 26, which in general are small compared to traditional mine shafts. Typically, the shafts 26 are large enough to accommodate approximately cubical machinery modules of about two feet along any side.

Following formation of the several shafts 26, certain ground level equipment shown schematically in FIG. 4 is placed. More particularly, a preferably mobile ingress-egress unit 28 is positioned at the top of one shaft 26 and this equipment unit contains hoisting means for raising and lowering mining machine modules, yet to be described, storage and handling means for such modules, and internal connections for a multiconductor sensing cable 29, a driving fluid conduit 30, a mined slurry removal conduit 31, and a back filling material conduit or line 32. The elements 29, 30 , 31, and 32 extend into the shaft 26, FIG. 4, for connection with certain machinery units, to be described, and also have above ground extensions, as illustrated.

The ground level equipment further comprises an electrical power source 33 having an output cable 34 including branches 35 which are connected to several ground level components which require electrical energy to operate. Among these components is a pump 36 connected in the mined slurry conduit 31 for constantly delivering mined coal in water slurry form to a transporting pipe line 37 during the coal mining operation. A manned control center 38 is provided and has electical connections with the sensing cable 29. The control center 38 also includes geophone means 39, as shown. Load cells or other known types of sensing devices placed on the subterranean mining modules, yet to be described, operate in conjunction with the sensing cable 29 and geophone means 39 to constantly feed into the control center 38 electrical signals which are indicative of the positions of mining modules relative to the coal seam and the shafts 26. By means of continuous sensor readouts, an operator in the control center 38 can monitor the unmanned mining modules far below ground level while remotely controlling the same from the control center.

An above ground reservoir 40 and delivery pump 41 for driving fluid in the conduit 30 are provided, as well as a reservoir 42 and mixing and pumping unit for back filling slurry in the line 32. Back filling solids, chemicals or additives are delivered at proper times from a hopper 44 to a conveyor 45 which supplies the unit 43.

A feature of the invention is that the back filling materials employed to fill the subterranean mined cavity can actually be beneficial to the environment as by improving the quality of ground water and restoring certain minerals or the like in which the surrounding area may be deficient. This is in marked contrast to traditional coal mining procedures which notoriously damage the environment.

The below ground unmanned remotely controlled modular apparatus employed in the practice of the method, and forming the main subject matter of the invention comprises a single leading mining module 46 which has the ability to cut forwardly in the coal seam 25 on a radial path away from the shaft 26 and also to cut laterally at one side of the leading module. Behind the leading module 46 in rigidly coupled relationship is a plurality of identical side cutting mining modules 47 whose number will vary according to prevailing conditions in the coal seam 25, its size and thickness. The modules 46 and 47 are generally cubical in formation, or block-like, as best shown in FIG. 5. Their details of construction and operation will be fully described. The apparatus further includes a mining module placement and advancing unit 48 adapted to be raised and lowered in the shaft 26 by suspension cable means 49 connected with hoisting means of the ingress-egress unit 28. The unit 48 is adapted to transport the mining modules 46 and 47 one at a time to the coal seam 25 near the bottom of a shaft 26 and to advance them radially of the shaft into the coal seam in coupled relationship, as will be described. Additionally, the apparatus comprises a rotational driving unit 50 also adapted to be raised and lowered in the shaft 26 by cable means 51 winched from the ingress-egress unit 28 at ground level. The rotational unit 50 is adapted to be coupled to the rearmost side cutting module 47 in the rigid string of mining modules to drive the string on an arcuate path through the coal seam centered on a particular shaft 26, as will also be fully described.

Figure 10:
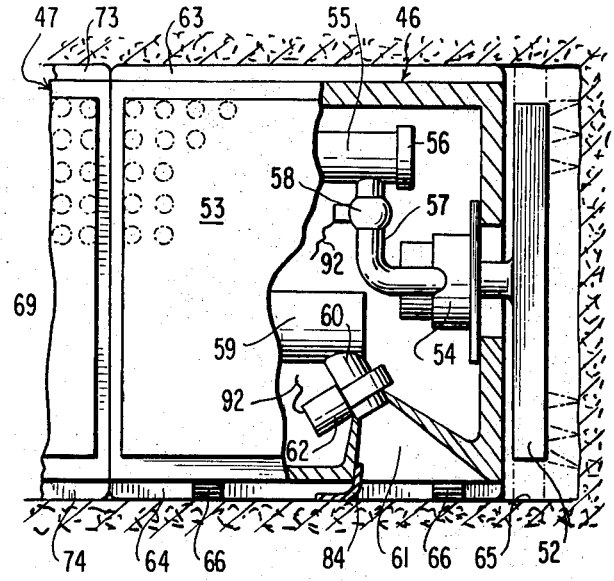
FIG. 10 is a fragmentary longitudinal vertical section through the leading module taken on line 10—10 of FIG. 5.

The previously-mentioned leading mining module 46 has a forward cutting head 52 and a single side cutting head 53, both adapted to be vibrated or oscillated in a known manner by a fluid driven motor 54 inside of the module 46, FIG. 10. A separate motor 54 is provided for each movable cutting head 52 and 53. The leading module 46 has an internal pipe section 55 for driving fluid (water) delivered at all times from ground level through the driving fluid conduit 30. The pipe section or passage means 55 is closed within the leading module 46 by a cap 56. An elbow 57 serves to connect the pipe section 55 with cutter head drive motor 54 so that driving fluid may be delivered thereto. The elbow 57 has an electrically controlled valve 58 connected therein whose operation will be further described.

The leading module 46 further includes a conduit section 59 for mined coal and water in slurry form which is closed at its forward end and has a short lateral branch 60 leading to an enlarged downwardly open slurry intake recess 61 at the bottom of the leading module. The branch conduit 60 has an electrically controlled valve 62 therein to regulate the volume of mined slurry entering the conduit 59 and ultimately delivered to the conduit 31 leading through the shaft 26 to the above ground transport pipe 37.

Near its side which is remote from the cutting head 53, the leading module has top and bottom seal plates 63 and 64 which are urged outwardly by spring means or fluid pressure means so that their edges will seal with the top and bottom faces of the mined cavity 65, FIG. 10. The module 46 is mounted on caster wheels 66 adapted to rotate freely through ninety degrees of rotation to enable the module 46 to move radially in a linear path through the coal seam away from one of the shafts 26 and subsequently to move laterally behind the side cutting head 53 on an arcuate path centered on the shaft 26.

The leading mining module 46 has a rear end female coupling means 67 including a top-to-bottom coupling slot 68 as shown in FIG. 5. As will become apparent, this female coupling means interlocks rigidly with a mating male coupling means on the forward end of a side cutting module 47.

Figure 9:
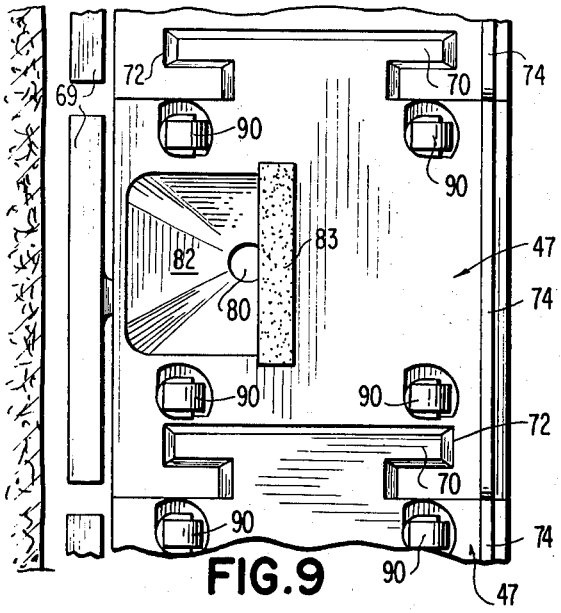
FIG. 9 is a fragmentary bottom plan view taken on line 9—9 of FIG. 7.

Each side cutting mining module 47 is similar to the leading module 46 but differs principally therefrom by having a vertical side cutting head 69 only and no forward cutting head. Each module 47 has a forward end male coupling head 70 including a lower tapered terminal 71 for guided entry into the coupling slot 68 of leading module 46, or into a like slot of another module 47. As depicted in FIG. 5, each module 47 has a rear end female coupling slot 72 identical to the slot 68 of leading module 46. At its side away from the cutting head 69, each module 47 has upper and lower longitudinal mined cavity seal plates 73 and 74 identical to the seal plates 63 and 64 and being aligned therewith to form continuous cavity seals when the modules are coupled in assembled relationship, FIGS. 9 and 10.

Each module 47 has a fluid-operated drive motor 75 for its side cutting head 69, FIG. 7, and connected through an elbow 76 with a driving fluid conduit section 77 in the module 47. The conduit section 77 is adapted to register with the similar conduit section 55 of leading module 46 as shown in FIG. 6 when the modules are rigidly coupled in end-to-end relationship. The elbow 76 has an electrically controlled valve 78 connected therein. Each module 47 has a mined slurry conduit section 79 therein extending lengthwise through the module and adapted to register with the slurry conduit section 59 of leading module 46 or with the conduit section 79 of another module 47. The conduit 79 is connected by a short branch section 80 having an electrically controlled valve 81 with a flared inlet 82 for slurry which opens through the bottom of each module 47 rearwardly of side cutting head 69. A flexible sealing flap 83 is preferably provided on the rear side of inlet 82 to wipe the bottom of cavity 65 and assist in guiding the mined slurry through the inlet 82. A similar flap 84, FIG. 10, is provided on the leading module 46.

A third longitudinal back filling material conduit 85 is provided in each module 47 but is absent in the leading module 46. Back filling slurry from the shaft conduit 32 is delivered through the conduit sections 85 of the side cutting modules 47 to back fill the mined cavity 65 with suitable material shown at 86 in FIG. 7. The back filling slurry passes from conduit section 85 and through a branch pipe 87 to a wide outlet slot 88 in the rear side of each module 47. Branch pipe 87 also has an electrically operated valve 89 connected therein so that the volume of flow of back filling material can be regulated remotely.

Like the leading module 46, each side cutting module 47 has bottom corner caster wheels 90 adapted to turn freely through 90° for the purpose explained in relation to the module 46. Each module 46 and 47 has a longitudinal front-to-back multiconductor cable section 91 extending therethrough, FIGS. 5 and 7, so as to form continuations of the sensing cable 29 when the modules are coupled as a rigid string end-to-end. In addition to conducting load cell or sensor signals back to the control center 38 at all times, the cable sections 91 are also electrically connected by wires 92 to the described electrically operated fluid flow control valves of modules 47 and 46.

As depicted in FIG. 7, the cutting head 69 of each module 47 has passages 93 continuously receiving driving fluid exhausted from the cutter head driving motors 75. This exhaust fluid (water) cools the coal cutting heads and flushes the coal cuttings in water slurry form into the slurry intakes 82 and 61 which intakes are under vacuum due to the action of the pump 36 and other booster pumps, not shown, which the slurry delivery system may embody. The front and side cutter heads 52 and 53 of leading module 46 are similarly equipped with passages 93 for the purposes described immediately above in connection with the cutting heads 69 of side cutting modules 47.

FIG. 6 shows interface fluid passage sealing means between leading module 46 and the adjacent module 47, and identical sealing means is included at the interfaces of all modules 47. This sealing means comprises at each communicating and registering fluid passage 77-55, 79-59 and 85-85 a spring-urged sleeve 94 carried by the rear side of each module 46 and 47 for entry into a recess 95 in the forward face of the next rear-most mining module. Each recess 95 contains an O-ring seal 96 or the like which is engaged and compressed by the end flange of spring-urged sleeve 94 to thus seal and maintain the integrity of the three fluid passages through the string of modules 47 and the two passages or conduits 55 and 59 of leading module 46. Other forms of interface seals may be used, if desired. When adjacent modules are coupled by downward entry of a coupling head 70 into a coupling slot 68 or 72, the tapered portion 71 will engage and retract the spring-urged sleeve 94 as a strike plate will retract a door bolt, and then the sleeves will snap into their respective recesses 95 of coupling heads 70.

Figure 11:
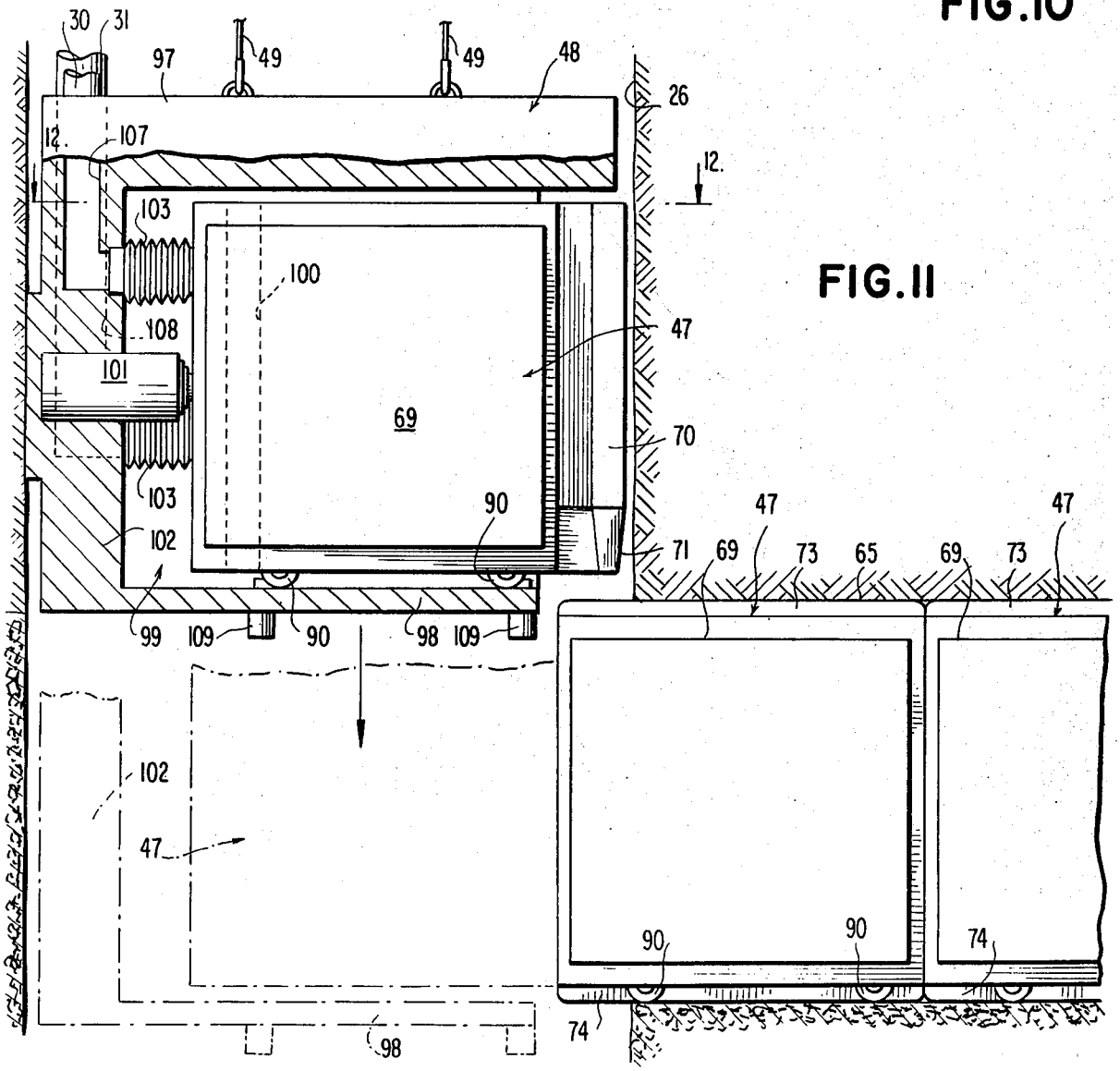
FIG. 11 is a vertical cross sectional view through a module placement and advancing unit with a side cutting mining module in transit thereon ready for coupling with the next forward-most mining module in the coal seam near the bottom of a shaft.
Figure 12:
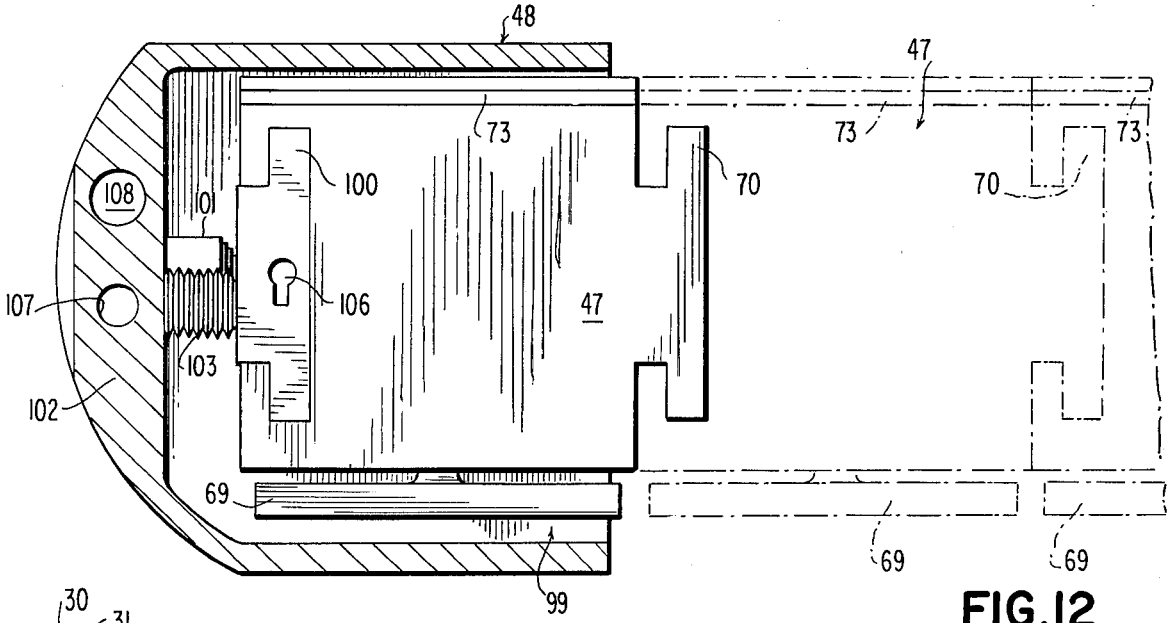
FIG. 12 is a horizontal section taken on line 12—12 of FIG. 11.
Figure 13:
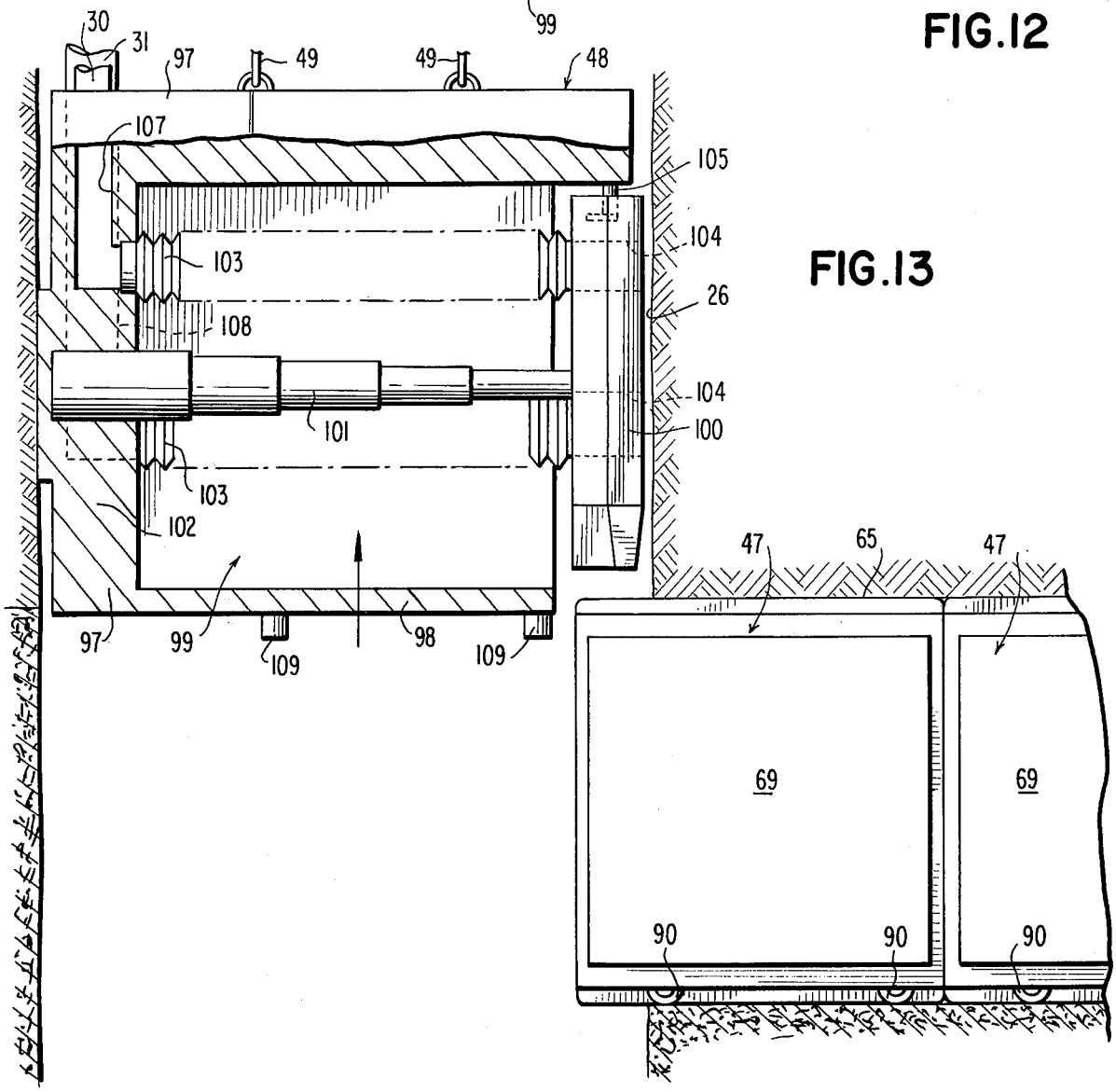
FIG. 13 is a view similar to FIG. 11 showing the module placement and advancing unit ascending in the shaft with its ram and coupling head extended, after having placed and advanced a mining module in the coal seam.

The previously-noted mining module placement and advancing unit 48 is particularly shown in FIGS. 11 through 13 and comprises an elevator carriage body 97 having a level floor 98 and having a mining module transport cavity 99 above the floor 98 which is forwardly open as shown. The unit 48 additionally comprises a forwardly and rearwardly shiftable male coupling head 100 essentially identical to the described coupling head 70 of the mining modules 47. The head 100 is connected to the forward end of an extensible and retractable fluid pressure operated ram 101 whose base section is securely anchored to the back wall 102 of carriage body 97. Flexible bellows-like conduits 103 have their forward ends coupled with registering passages 104 in the head 100, which passages are adapted for connection with the driving fluid and mined slurry passages 77 and 79 of mining module 47 so that these fluid circuits may be maintained during the radial advancement of the string of modules 46 and 47 into the coal seam 25 under influence of the ram 101 while the forward cutting head 52 of the leading module is activated.

To temporarily support the coupling head 100 of unit 48 when the ram 101 is extended, FIG. 13, a remotely controlled retractable and rotatable support lug 105 on the carriage body 97 near the top and mouth of the module cavity 99 enters a bayonet slot 106, FIG. 12 at the top of the head 100. When the coupling head 100 is retracted as in FIG. 12, the support lug 105 is rotated and withdrawn from the slot 106.

The rear ends of bellows conduits 103 are connected with rising passages 107 and 108 for driving fluid and mined slurry respectively. These fluid passages are formed in the back wall 102 and lead to and connect with the conduits 30 and 31 within shaft 26. Additionally, the floor 98 of carriage body 97 is preferably equipped with remotely controlled retractable caster wheel chocks or latches 109 although these elements may be omitted in some instances.

Figure 3:
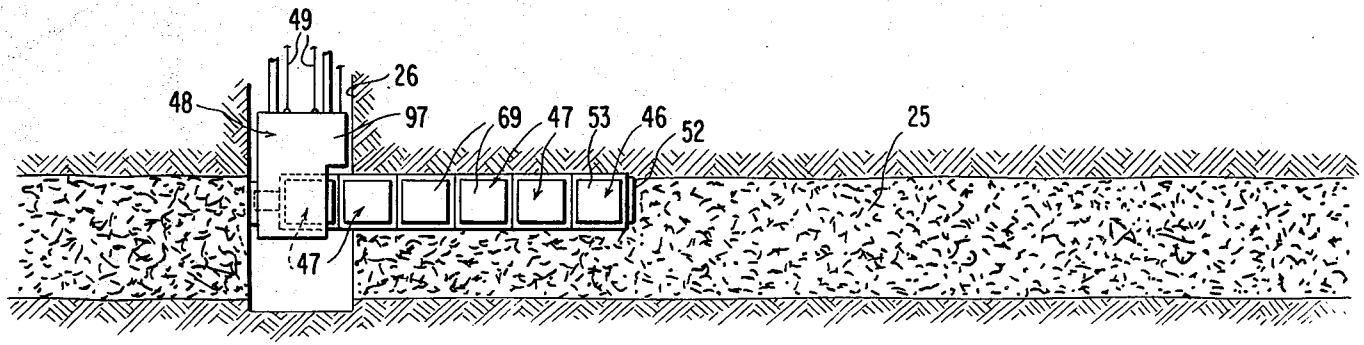
FIG. 3 is a cross sectional view through the coal seam showing a module placement and advancing unit near the bottom of a shaft forcing coupled mining modules radially into the top of the seam from said shaft.

In operation, the mining module placement and advancing unit 48 has its male head 70 coupled with the rear slot 72 of a module 47 or with a comparable slot 68 of the module 46 at ground level with the ram 101 and head 100 extended. The ram is then retracted to draw a mining module onto the floor 98 and within the chamber 99 or cavity of the unit 48, see FIG. 11. The unit 48 is then lowered in the shaft 26 to a point immediately above the coal seam and the male coupling head 70 of the transported module is slowly introduced into the female coupling slot 72 of the next module 47 immediately ahead in the coal seam, which is the rearmost module 47 of the string already advanced radially into the coal seam. When the coupling procedure is completed, the ram 101 is extended to force or advance the transported module 47 radially into the coal seam and when this has been done, the unit 48 is elevated as shown by the arrow in FIG. 13, thus removing the coupling head 100 from the now in place module 47, the unit 48 returning to ground level preparatory to receiving and placing another module 47, if such is indicated. FIG. 3 of the drawings graphically illustrates the utilization of the unit 48 for forcing a transported module 47 radially into the coal seam 25 in rigidly coupled relationship with other modules which have already been placed in the seam. While this placement operation is taking place, the forward cutting head 52 is active for cutting into the seam, and the resulting coal cuttings in slurried form are being delivered through the shaft 26 to the transport pipe line 27, as described.

Following the described placement and advancement of a desired number of mining modules 46 and 47 in the coal seam 25 as a rigidly coupled string extending radially of one shaft 26, the rotational driving unit 50, FIGS. 4 and 14 through 16, is now employed to turn or rotate the entire string of modules through an arcuate path of movement in the coal seam, centered about the shaft 26 and in the direction toward which the now active side cutting heads 69 are all facing.

The rotational driving unit 50 is adapted to be raised and lowered bodily through the shaft 26 from the ground level unit 28, as previously noted. It comprises an upper relatively stationary section 110 and a lower rotational section 111, as shown. The upper section 110 has remotely controlled radial power-operated pins or lugs 112 which penetrate the side wall of shaft 26 to lock the unit in place near the bottom of the shaft at the proper elevation in relation to the rigid string of mining modules 46 and 47. The elements 112 can be retracted into the section 110 at proper times. A fluid-operated drive motor 113 on the upper stationary section 110 is coupled through a drive shaft 114 with a long depending spline gear 115 which is received through a central vertical splined opening 116 in the lower rotational section 111 so as to form a very strong and secure rotational coupling. As will be described, in certain circumstances, the lower unit 111 can move downwardly along the spline gear 115 and away from the stationary upper unit 110. The lower unit 111 has a male coupling head 117 on its forward side substantially identical to the head 70 or 100 and a female coupling slot 118 in its rear side substantially identical to slots 68 or 72. The element 117 is adapted to rigidly couple with the rear end of the rearmost side cutting module 47 in the coal seam when the rotational unit 50 is lowered into place in the shaft 26.

The lower section 111 of unit 50 has fluid passages 119, 120 and 121 for driving fluid, back filling material and mined coal slurry, respectively, adapted to register with the respective passages 77, 85 and 79 of the adjacent module 47, so that the several fluid systems may be operational during rotation of the coupled string of mining modules by means of the unit 50. The fluid passages 119, 120 and 121, FIG. 14, open horizontally through the coupling head 117 and also extend vertically through the top of the rotational section 111. At this level, the passages 119, 120 and 121 communicate with concentric annular channels 122, 123 and 124 of a header 125 which is constrained from rotating with the section 111 by attached upstanding rods 126, such rods extending slidably through vertical guide openings 127 in the upper stationary section 110. This arrangement allows the lower unit 111 to move axially on the long spline gear 115 at certain times while rotating relative to the upper section 110, as will be further described. It also allows the header 125 having the annular channels 122, 123 and 124 to be held stationary while the tops of passages 119, 120 and 121 rotate with the section 111 and thereby maintain the integrity of the several fluid circuits involved.

Figure 14:
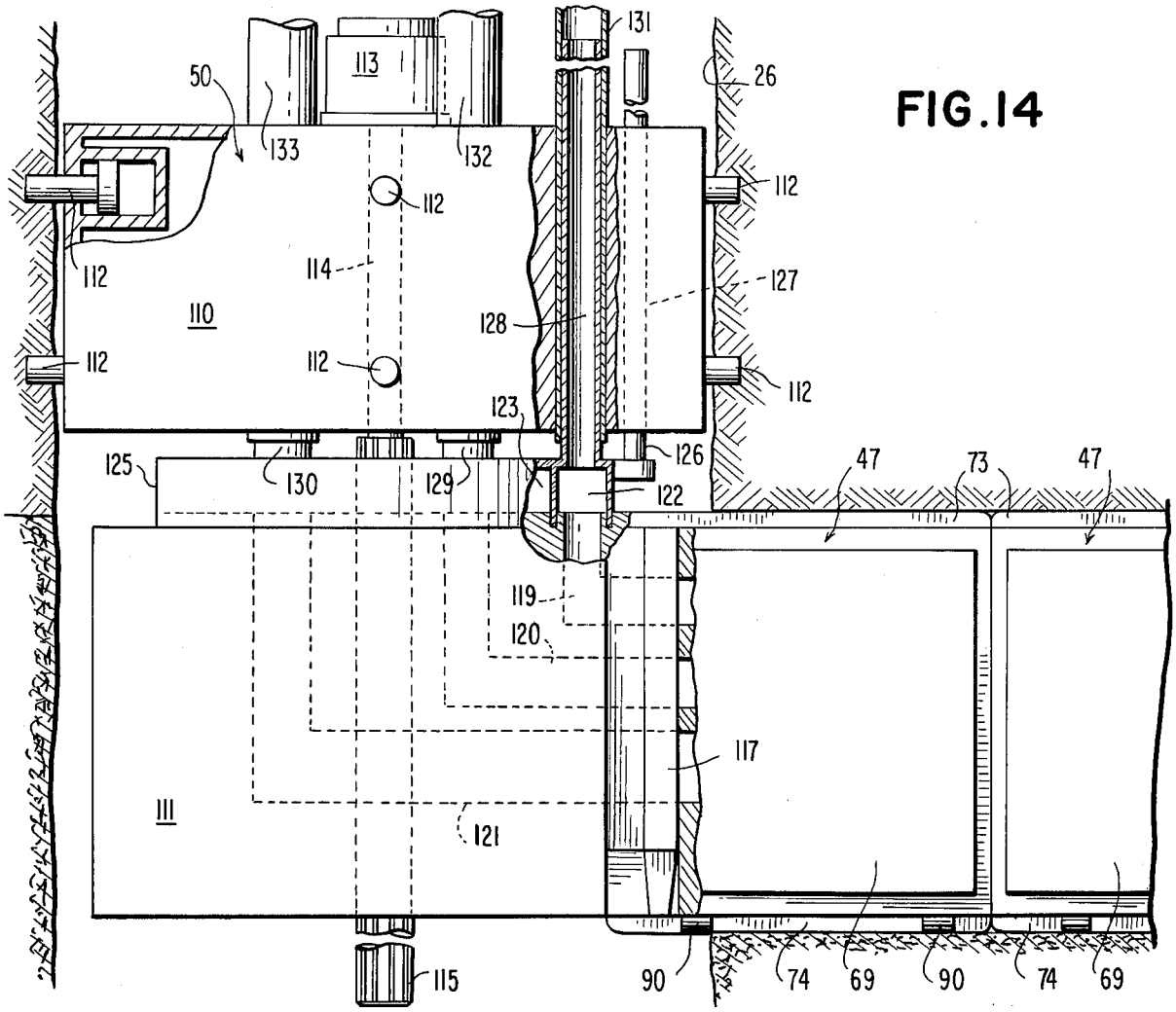
FIG. 14 is a further view similar to FIG. 13 showing a rotational driving unit for coupled mining modules at the bottom of the shaft and coupled with the rearmost side cutting module for driving a string of coupled modules through the seam on an arcuate path centered on said shaft.
Figure 15:
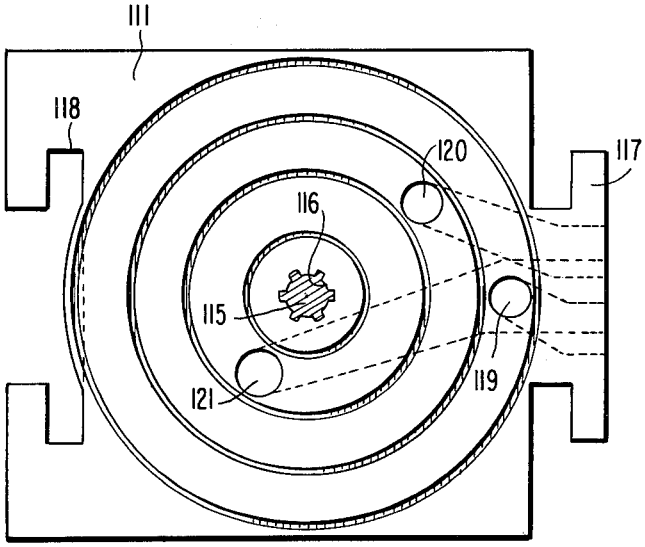
FIG. 15 is a plan view of the lower rotational section of the rotational driving unit and associated fluid passage means.
Figure 16:
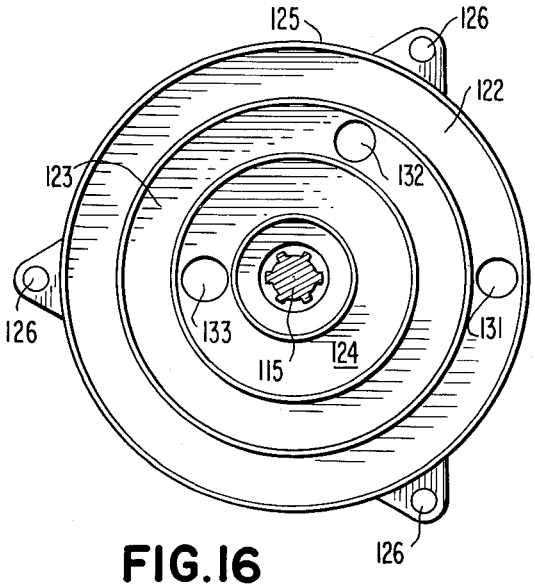
FIG. 16 is a bottom plan view of the upper non-rotatable section of the rotational driving unit.

The channels 122, 123 and 124 lead respectively into attached riser conduits 128, 129 and 130, FIG. 14, having sliding telescoping engagement within mating tubes or conduits 131, 132 and 133 which in turn are coupled with the conduits 30, 32 and 31, FIG. 4, for driving fluid, back filling material and mined coal slurry.

When the rotational driving unit 50, as described, is properly positioned relative to the coal seam 25 and string of modules 46 and 47, FIGS. 4 and 14, and with the upper section 110 held against rotation by the extended lugs 112, the rotational drive motor 113 is activated and the spline gear 115 is turned to rotate the lower section 111 whose coupling head 117 is rigidly coupled with the rearmost side cutting module 47. With all of the side cutting heads 69 and 53 active, the unit 50 will drive the string of modules 47 and 46 substantially horizontally through the coal seam 25 on an arcuate path centered on the shaft 26 and the rotational axis of the unit 50 therein. The angular extent of this rotational movement of the modular mining apparatus may vary from a relatively small angular sector to a full circle of rotation in the coal seam. While such movement is occurring, driving fluid for the cutting head motors 75 is being continuously delivered through the flexible conduit 30 and communicating passages 119, 77 and 55. The fluid exhausted by the several cutter head motors after passing through the openings 93 entrains the coal cuttings as a water slurry and delivers this mined slurry through the inlets 82 and 61 to the module passage means 59 and 79 which communicate with passage 121 and ultimately flexible slurry delivery conduit 31 and slurry transport pipe 37, FIG. 4.

Simultaneously, while the angular rotation of the coupled mining modules is taking place under driving power of the unit 50, the back filling materials or slurry 86, FIG. 7, is constantly being pumped through the flexible conduit 32 and passage means 120 and 85 and through the several outlet slots 88 of modules 47. This back filling slurry is under pressure and the fluid pressure is utilized to push the rear sides of the coupled modules 47 in conjunction with the power of rotational unit 50 to advance the side cutting heads 69 into the coal seam 25 and thus assist the rotational sweep of the mining modules. The sealing plates 73 and 74 and 63 and 64 maintain the back filling slurry 86 separated from the mined coal slurry during the entire operation. The oscillatory movement of the cutting heads 69 and 53 is of sufficient magnitude, as shown in dotted lines in FIG. 7, to carve out the cavity 65 in sufficient depth to allow the castered modules to pass slowly through the coal seam under the combined power of the unit 50 and the back pressure or boosting power of the material 86 which is in fluid form.

Referring now to FIGS. *2a*, *2b* and *2c* and related FIGS. 17 and 18, the coal mining method utilizing the described apparatus is now readily understandable. With the coupled string of modules 46 and 47 centered on one shaft 26 with the rotational driving unit 50, FIGS. 4 and 17, the arcuate movement of the coupled modules can continue, for example, in a semi-circular arc, FIG. *2a*, or in a lesser arc, such as 90°, FIG. *2b*, or in some cases for more than 180° of rotation, FIG. *2c*, to produce a variety of cutting patterns through the coal seam 25 depending upon its area and marginal shape. FIGS. *2a* to *2c* thus show the versatility of the method which enables substantially all of the coal to be mined from a given seam regardless of the shape, area or thickness of the seam.

More particularly, with reference to FIGS. *2a* through *2c*, 17 and 18, the initial arcuate sweep of the coupled mining modules 46 and 47 through the coal seam by rotational unit 50 centered on one shaft 26 will continue, as in FIGS. *2a* to *2c*, until the leading module 46 arrives at a seccond prepared shaft 26 of the gridwork of shafts. This can occur following various extensive rotation, as discussed, relative to the patterns in FIGS. *2a–2c*. In any case, after the leading module 46 reaches a second shaft 26, FIG. 17, it is uncoupled from the next rearmost side cutting module 47 and lifted from the second shaft by an elevating unit 134 which is lowered into the second shaft 26 from ground level by hoisting means. The rotational unit 50 may now be removed from the first shaft 26, FIG. 17, and lowered into the second shaft 26, FIG. 18, to be coupled with the now rearmost module 47 which previously during the first rotational cycle was the leading side cutting module behind the module 46. Also, in FIG. 18, to close off the open fluid passage means 77, 79 and 85 of module 47 at the first shaft 26, now the leading module, a closure plate 135 of the same configuration as male coupling head 70 or 100 is now delivered by another raising and lowering device 136 and placed in the coupling slot 72 of the particular module 47. The coupling head 70 of the now rearmost module 47 at the second shaft 26, FIG. 18, enters the slot 118, FIG. 15, of the lower rotational section 111 of unit 50. When this procedure is completed, the coupled string of modules 47 is again rotated as a unit in a second arcuate path by the rotational unit 50 centered on the second shaft 26 to the required extent as depicted in any of FIGS. *2a*, *2b* or *2c*. This step-by-step rotational movement of the modular mining apparatus from shaft-to-shaft is continued until virtually all coal is removed from the seam 25 and delivered above ground as a slurry to the transport pipe line 37. It may be mentioned here that all remote controls for the apparatus are of a conventional nature under existing technology and are located in the manned control center 38.

A comparison of FIGS. 4, 17 and 18 illustrates how the coupled mining modules during their rotational travel through the seam can gradually descend along the spline gear 115 from the top to the bottom of the seam so as to completely mine the full thickness of the coal seam 25.

As suggested by the variants in FIGS. 19 and 20, the apparatus also may have the capability of boring downwardly through a very deep coal seam 25' while centered on a particular shaft 26 under the rotational power of a rotational driving unit 50' very similar to the described unit 50 and having a greatly elongated driving spline gear 115' projecting through the shaft 26 from the top to bottom of deep seam 25'. The modified mining modules 47' for this repetitive full circle boring technique are virtually identical to the described modules 47 and differ therefrom only in that the side cutting heads 69' are pivotally connected at 137 adjacent their lower edges to the body of the module 47' and are adjustable angularly relative to the vertical about such pivot axis by an extensible and retractable remotely controlled ram 138 provided within each module 47' at the top of the side cutting head 69' and connected thereto, as shown. To accommodate angular adjustment of the head 69', a bellows section 139 is placed in the described elbow 76, see FIG. 7.

By virtue of the modified arrangement, the coupled string of mining modules 47' can actually be remotely steered downwardly through the coal seam 25' in a boring mode by simultaneously tilting the side cutting heads 69' on their pivots 137. To accomodate this steering and the resulting angular rotation of the module string on its longitudinal axis radially of the shaft 26, a swiveled connection 140, FIG. 19, is provided between the lower rotational section 111' of unit 50' and the adjacent module 47'. As the coupled modules 47' revolve in a full circle mode around the vertical axis of unit 50', they will gradually bore downwardly through the thick coal seam 25' while descending on the spline gear 115'.

SUMMARY OF OPERATION

While the mining method is already essentially described in connection with the apparatus components and how they are employed, the method can be summarized in the following terms. After surveying the field to analyze the coal seam 25 and laying out and forming the gridwork of shafts 26, and properly locating all of the ground level equipment shown in FIG. 4, the actual mining method can begin.

By utilizing the module placement and advancing unit 48 as described in full detail, the leading mining module 46 with forward and side cutting heads and all succeeding side cutting modules 47 are placed one at a time in coupled relation in the seam 25, FIG. 3, and advanced radially of the shaft 26 therein while the initial coal cuttings produced by the cutting head 52 are withdrawn through the described module passages and delivered through the conduit 31 to the transport pipe 37. No back filling material is introduced at this stage.

When a mining module string of the required length has thus been placed in the coal seam 25, as depicted in FIG. 4, the rotational movement of the rigidly coupled string through the seam horizontally under influence of the unit 50 and with the back pressure assistance of back filling slurry 86 is commenced, centered on one shaft 26. Following a desirable angular sweep, as shown in FIGS. *2a* to *2c*, and after the leading module 46 reaches a second shaft 26 as described in connection with FIG. 17, the leading module 46 is removed through the second shaft and the rotational driving unit 50 is coupled with the module string in the second shaft and rotates the string on a second arcuate path of movement centered on the second shaft, following which the procedure may be repeated step-by-step through the entire coal seam 25 in any of the patterns shown in FIGS. *2a* to *2c* and other possible pattern variations.

During all of this procedure, driving fluid (water) is introduced from ground level through conduit 30 and through the communicating passages in the several mining modules and the two units 48 and 50 as described in detail. Likewise, the mined slurry withdrawal passages of the modules and the units 48 and 50 are all operational so that mined coal slurry can constantly flow upwardly through the flexible conduit 31 to transport pipe line 37. Similarly, the back filling slurry system including conduit 32 and the connected passage means of the unit 50 and the several modules 47 is operational.

It may also be mentioned that the electrical sensing cable 29 leading from the control center 38 is operational through all of the coupled mining modules 47 and 46 and through the units 48 and 50 as all of these apparatus components are equipped with built-in multiconductor cable sections as at 91 in FIG. 5 which are electrically coupled in the system when the modules are coupled with each other and with the units 48 and 50.

In connection with the previously-mentioned valves 78, 58, 81, 89 and 62 for the fluid lines 77, 79, 85, 55 and 59, FIGS. 7 and 10, these several fluid control valves on each module 46 and 47 are remotely controlled electrically through the sensing cable 29 and associated wires 92 so that the amounts or volumes of flow in the three fluid systems can be regulated at each mining module. Such independent fluid flow regulation is necessary due to the fact that during a rotational sweep of the coupled modules through the coal seam 25 while centered on a shaft 26 the leading modules remote from the shaft do much greater work comparatively than the modules closer to the shaft 26 and unit 50. The electrically controlled valving arrangement allows the amount of driving fluid (water) from the conduit 29 to be regulated at each mining module so that the associated cutter head drive motor 75 can do more work or less work and produce more coal slurry or less coal slurry, as the working requirement for that particular modules dictates. Likewise, the individual valves 81 of the slurry delivery passage means are individually regulated remotely, and the back filling material valves 89 can be remotely controlled. With this control capability, the mining modules can be utilized efficiently with minimum power and maximum production of mined slurry.

In addition to the above, the method can, in some cases, be practiced by utilizing mining modules which are self-propelled and self-powered, such modified modules being omitted from the present drawings. When employed, the self-propelled modules can drive themselves radially from a shaft 26 outwardly into the coal seam and under remote control from ground level can propel themselves on an arcuate path through the seam centered on the shaft, substantially as described. When employed, the mining modules will not require the ram means 101 of the module placement unit 48 and will not require the use of rotational drive unit 50 at all. Otherwise, however, the equipment and operational procedures will be the same as described previously.

It should now be understood by those skilled in the art that the invention offers a practical and economical means for recovering coal from subterranean relatively thin coal seams which heretofore could not be economically mined. Since no human workers are utilized below ground level, the safety aspect of the invention is ideal. Also, in contrast to the prior art, the invention is ecologically sound in that it does no damage to the environment and can even be utilized to improve water quality and the mineral content of the soil. Most importantly, the invention is thought to offer at least a partial solution to the current energy crisis because it is designed to recover coal economically and in vast quantities from deep seams or veins where most of the coal reserves are now located. A main feature of the invention is that virtually all of the coal is recoverable from a given seam rather than a mere fraction of the usable coal as in the traditional prior art.

It is to be understood that the form of the invention herewith shown and described is to be taken as preferred example of the same, and that various changes in the shape, size and arrangement of parts may be resorted to, without departing from the spirit of the invention or scope of the subjoined claims.

I claim:

1. A method of mining coal, minerals and other minable materials beneath the surface of the earth comprising forming a shaft from ground level downwardly to intersect a subterranean seam, assembling a string of interconnected mining modules in the seam by cutting substantially radially into said seam and away from said shaft by a lead module and removing cuttings from said seam and delivering them through said shaft to ground level, and further cutting into said seam on a second path by said string of interconnected mining modules along one side of the radial cut and removing cuttings from said seam and delivering them through said shaft to ground level.

2. A method of mining as defined by claim 1, and delivering water through said shaft and into said seam during cutting to reduce cuttings to a liquid slurry for delivery to ground level.

3. A method of mining as defined by claim 1, and back filling the cavity formed in said seam by cutting on said second path.

4. A method of mining as defined by claim 3, and said back filling comprising introducing a back filling slurry through said shaft from above ground into said cavity and utilizing the pressure of said slurry to advance a cutting means through said seam on said second path.

5. A method of mining as defined by claim 1, and the additional steps of forming plural shafts from ground level downwardly in intersecting relation with said seam on predetermined centers, and continuing said cutting of said seam on said second path comprising an arcuate path centered on the first-named shaft until a second shaft is intersected in said seam, and then cutting into said seam on a second arcuate path substantially centered on said second shaft and removing cuttings produced during the second arcuate path cut through said second shaft to ground level.

6. A method of mining as defined by claim 1, wherein said second path comprises an arcuate path, and continuing to cut into said seam on said arcuate path through plural complete circles around said shaft and gradually downwardly through said seam substantially axially of said shaft while continually delivering cuttings from the seam to ground level through said shaft.

7. A method as defined by claim 1, wherein said step of assembling said string comprises assembling self-propelled modules in the seam said modules driving themselves radially from said shaft and thereafter under remote control propelling themselves on said second path.

8. A method of mining material from a subterranean seam of minable solids through a prepared shaft which extends from ground level into said seam comprising the steps of placing mining modules one at a time through said shaft into said seam, coupling said modules in interconnected relationship and forcing each module radially away from said shaft and through said seam behind the leading module until a predetermined number of said mining modules are located in said seam in coupled relationship, rotating all of the coupled modules as a unit through said seam on an arcuate path substantially centered on said shaft, and delivering said material mined by said modules to ground level through said shaft.

9. A method of mining as defined by claim 7, and the additional step of delivering water through said shaft and into said seam for the purpose of entraining mined material and delivering it to ground level as a water slurry.

10. A method of mining as defined by claim 8, and the additional step of delivering back filling material through said shaft into the cavity of said seam behind said coupled modules as the latter rotate through said seam on said arcuate path.

11. A method of mining as defined by claim 7, and forming additional shafts from ground level into said seam on predetermined centers with said prepared shaft, continuing said rotation of said coupled modules on said arcuate path until the leading module is adjacent a second shaft, removing the leading module through the second shaft, and then rotating all of the remaining coupled modules through said seam on another arcuate path centered on said second shaft while continuing to deliver mined coal through the second shaft to ground level.

12. A method of mining as defined by claim 10, and additionally sealing off the end of the rearmost module through the first shaft upon removing the leading module for effecting a closed circuit delivering path.

* * * * *